US007934956B1

(12) United States Patent
Hsia

(10) Patent No.: US 7,934,956 B1
(45) Date of Patent: May 3, 2011

(54) CONNECTOR FOR A CABLE

(76) Inventor: Yvonne C. Hsia, Taichung (TW)

( * ) Notice: Subject to any disclaimer, the term of this patent is extended or adjusted under 35 U.S.C. 154(b) by 0 days.

(21) Appl. No.: 12/849,837

(22) Filed: Aug. 4, 2010

(51) Int. Cl.
*H01R 13/40* (2006.01)

(52) U.S. Cl. ..... 439/587; 439/460

(58) Field of Classification Search ..... 439/460–462, 439/578, 587–589, 321
See application file for complete search history.

(56) References Cited

U.S. PATENT DOCUMENTS

| | | | | |
|---|---|---|---|---|
| 5,431,583 | A * | 7/1995 | Szegda | 439/589 |
| 5,830,009 | A * | 11/1998 | Tettinger | 439/578 |
| 7,097,500 | B2 * | 8/2006 | Montena | 439/587 |
| 7,264,503 | B2 * | 9/2007 | Montena | 439/587 |

* cited by examiner

*Primary Examiner* — Khiem Nguyen

(57) ABSTRACT

A connector for a cable contains a connecting sleeve, an internal tube, an inner fitting member, an outer fitting member, a sheath member, and a circular paw piece, wherein the inner fitting member, the outer fitting member, and the sheath member are made of plastic material, so that the connector is assembled easily and conveniently without using an auxiliary tool, and can lower production cost and time.

5 Claims, 6 Drawing Sheets

CONNECTOR FOR A CABLE

BACKGROUND OF THE INVENTION

1. Field of the Invention

The present invention relates to a connector for a cable that is assembled easily and conveniently.

2. Description of the Prior Art

Cable is used to transmit image or electronic signal/data, and includes a joint disposed on a connecting end thereof to be fixed to an entry of an electronic device.

Conventional joint for the cable is comprised of a plurality of separated connecting components, and the connecting components are made of metal material. Therefore, the components of the joint can not be assembled easily because of high metal hardness, and they have to be assembled together by using an auxiliary tool. Besides, the components are made of metal material to enhance production cost.

The present invention has arisen to mitigate and/or obviate the afore-described disadvantages.

SUMMARY OF THE INVENTION

The primary object of the present invention is to provide a connector for a cable that is assembled easily and conveniently without using an auxiliary tool.

Another object of the present invention is to provide a connector for a cable that is made of plastic material to lower production cost and time.

To obtain the above objectives, a connector for a cable provided by the present invention comprises a connecting sleeve formed in an annular tube shape, and including threads formed around an inner wall of a first opening of an upper end thereof, and including a shoulder extending around a bottom end of an inner wall thereof;

an internal tube fitted to the connecting sleeve and formed in a hollowly elongated tube shape to insert a core segment of the cable, and including an arresting ring extending outward around an upper end thereof to abut against the shoulder of the connecting sleeve, and including a circular groove arranged around an outer wall thereof;

an inner fitting member being a hollow housing, and including an orifice formed on a bottom end of a fifth opening thereof, and including a hole disposed on a top surface thereof, the hole including a circular projection formed around an inner surface thereof to correspond to the circular groove of the internal tube such that the inner fitting member is fitted to the outer wall of the internal tube by using the hole and further enable to rotate the connecting sleeve, the inner fitting member also including at least one curved recess formed on an upper end of an outer wall thereof, the recess becoming concaved upward to downward from the upper end of the inner fitting member, and after bending toward one side of the inner fitting member and extending downward, and the inner fitting member further including an insertion extending from a bottom end thereof;

an outer fitting member being a hollow housing and including two ends, each having a second opening, to be fitted to the inner fitting member, and including a protrusion extending from an inner rim of the second opening of a top end thereof in response to the recess of the inner fitting member, and including a first fixing section disposed on a bottom end thereof;

a sheath member being flexible and formed in a tube shape, and including two ends, each having a third opening, including a bore mounted on an upper end thereof, and the bore including a waterproof member extending from an inner surface thereof and becoming tilted toward a central portion thereof slightly, including an annular cutout formed on an outer surface thereof, the sheath member also including a raised loop, an outer diameter of which is in response to an inner surface of the outer fitting member, the raised loop including a second fixing section arranged on an outer surface thereof to correspond to a retaining trench of the first fixing section of the outer fitting member, including a circularly projected slit disposed on an inner surface thereof to correspond to the annular cutout of the bore;

a circular paw piece being a circularly metal ratchet paw and including a plurality of paws arranged thereon to be fixed between the outer fitting member and the raised loop, and the paw being a resilient metal element and tilting forward lightly.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
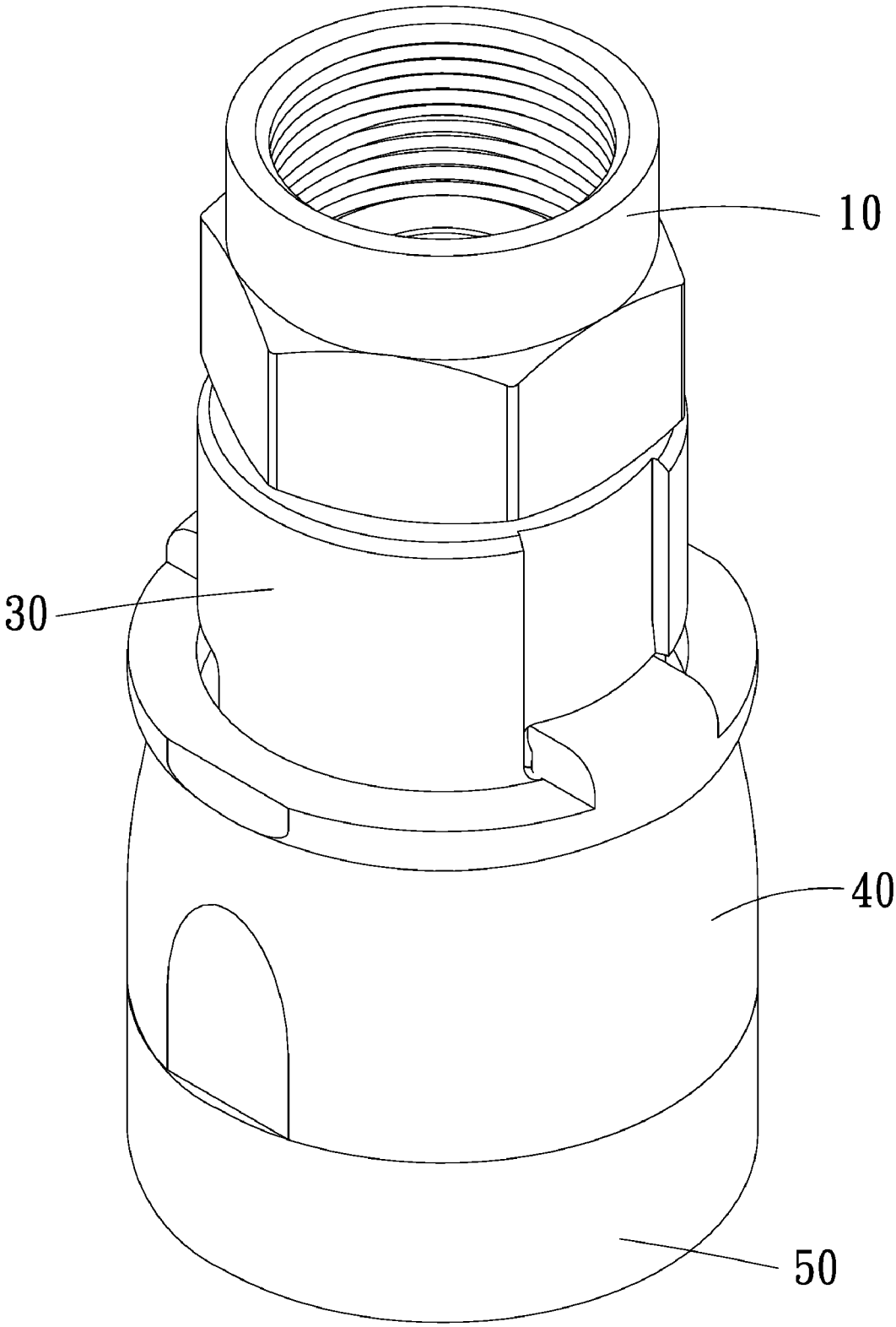
FIG. 1 is a perspective view showing the assembly of a connector for a cable according to a preferred embodiment of the present invention.
Figure 2:
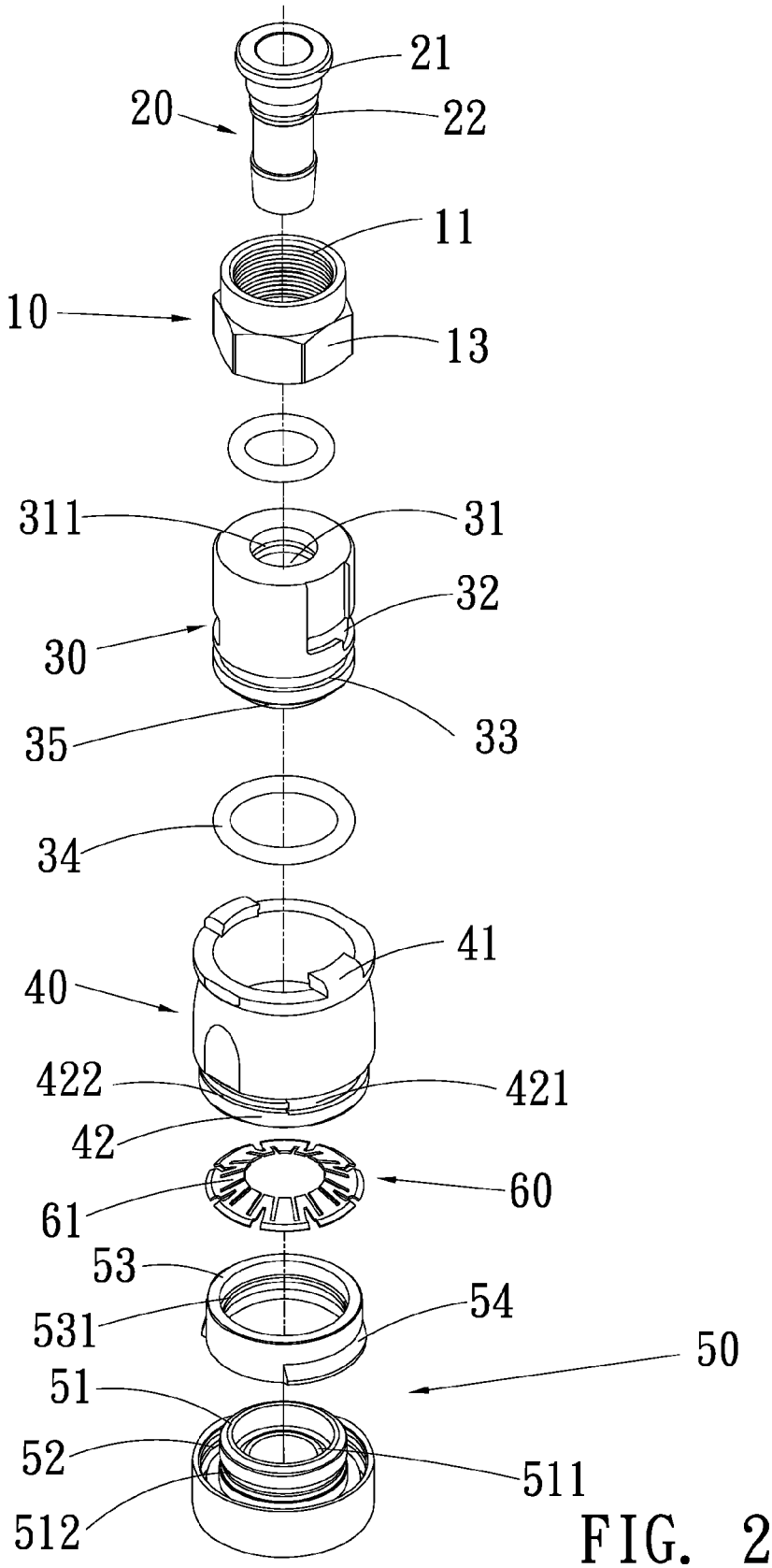
FIG. 2 is a perspective view showing the exploded components of the connector for the cable according to the preferred embodiment of the present invention.
Figure 3:
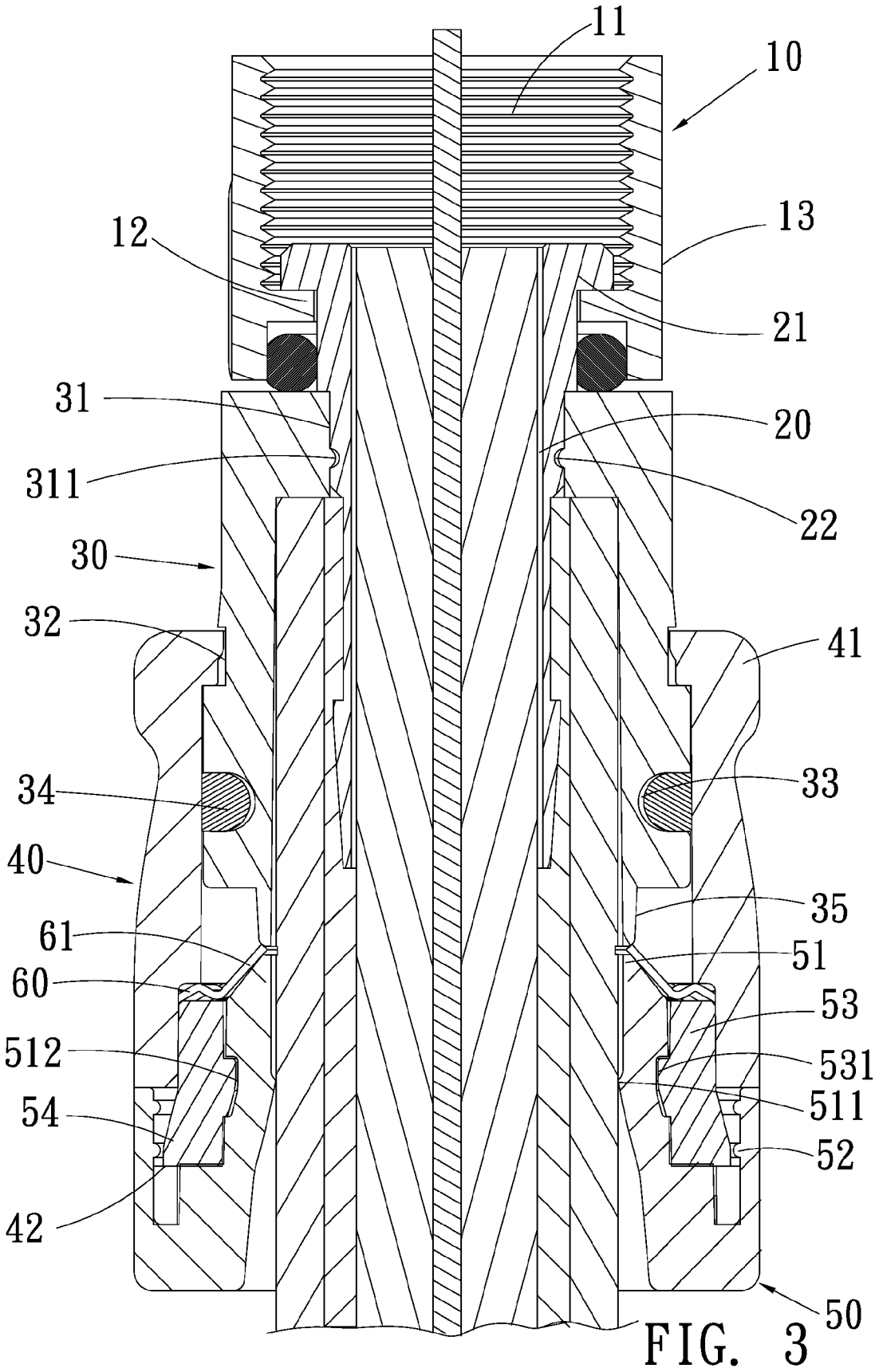
FIG. 3 is a cross sectional view showing of the assembly of a fixed cable according to the preferred embodiment of the present invention.
Figure 4:
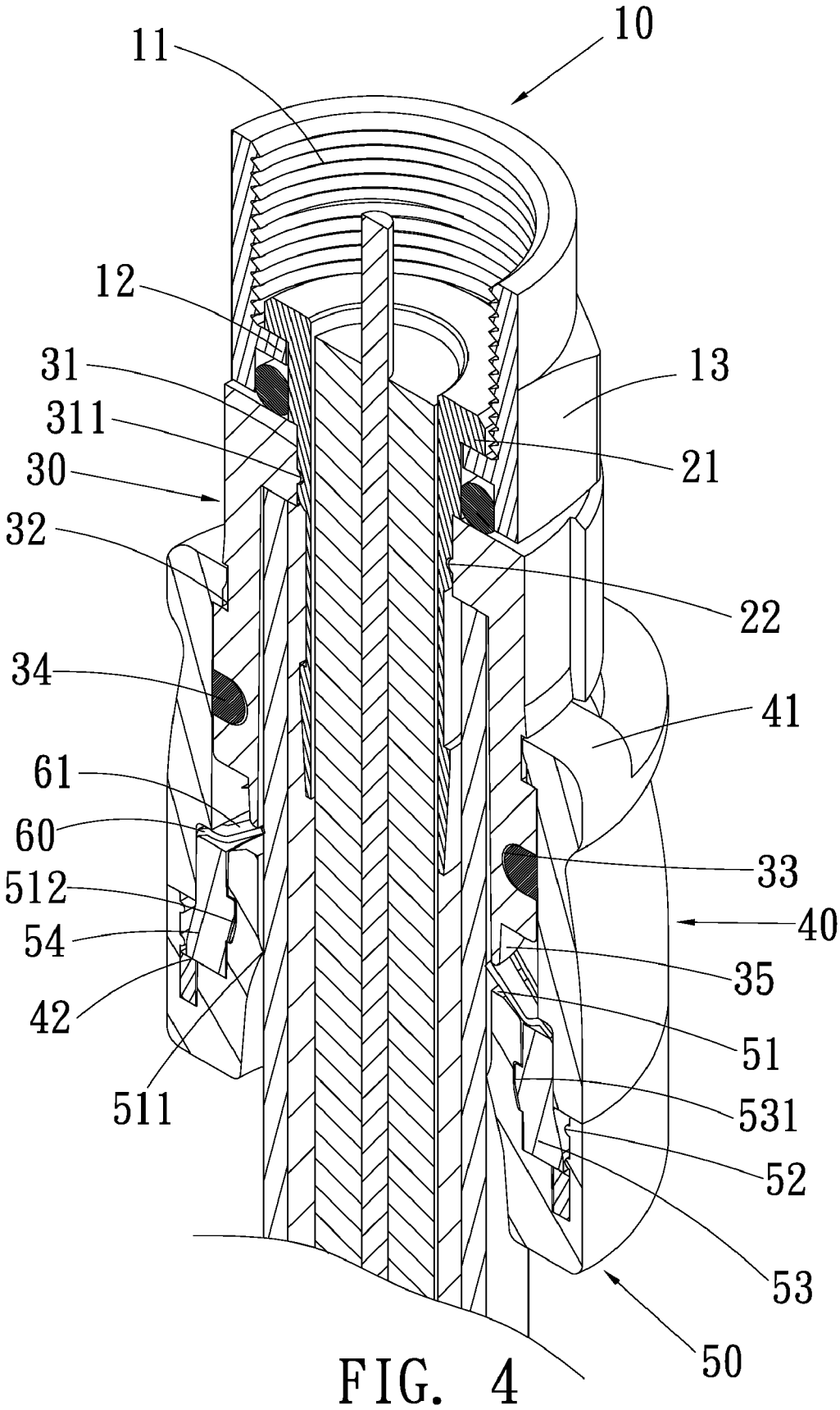
FIG. 4 is a perspective view showing the cross section of the fixed cable according to the preferred embodiment of the present invention.
Figure 5:
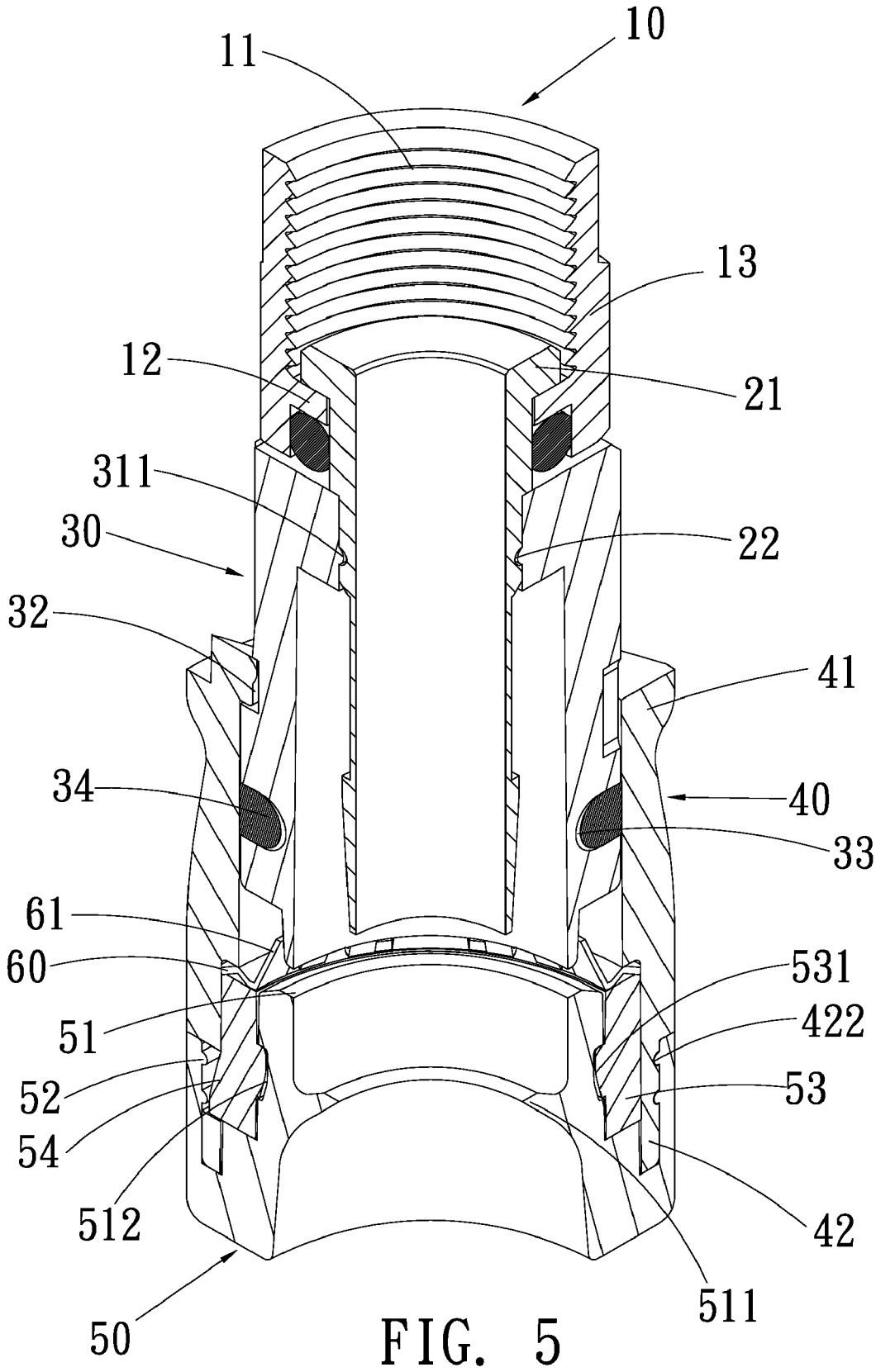
FIG. 5 is a cross sectional view showing of the assembly of an unfixed cable according to the preferred embodiment of the present invention.
Figure 6:
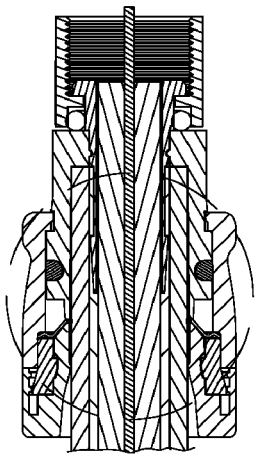
FIG. 6 is a cross sectional view showing a part of the fixed cable according to the preferred embodiment of the present invention.
Figure 6A:
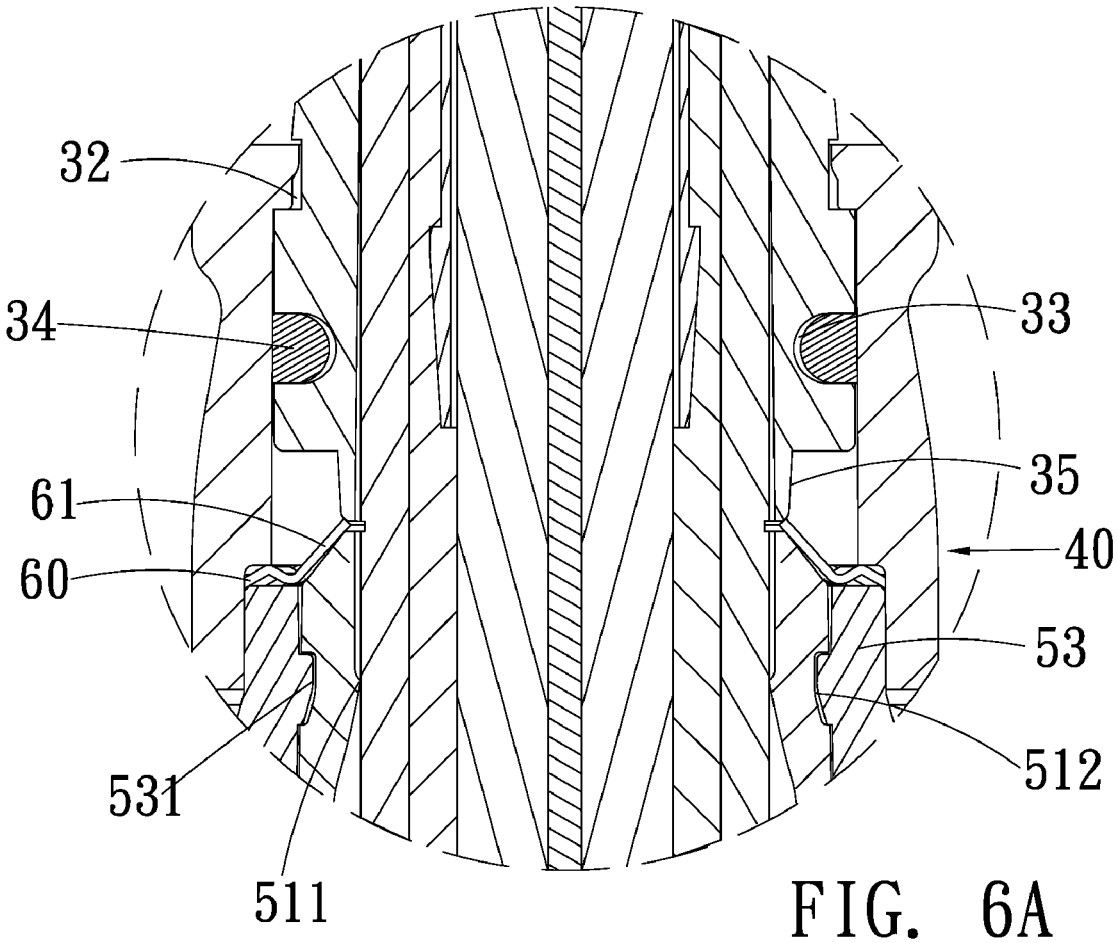
FIG. 6A is an amplified cross sectional view showing a part of the fixed cable according to the preferred embodiment of the present invention.

Referring to FIGS. 1-6 and 6A, a connector for a cable in accordance with a preferred embodiment of the present invention includes a connecting sleeve 10, an internal tube 20, an inner fitting member 30, an outer fitting member 40, a sheath member 50, and a circular paw piece 60, wherein the inner fitting member 30, the outer fitting member 40, and the sheath member 50 are made of plastic material.

The connecting sleeve 10 is formed in an annular tube shape, and includes threads 11 formed around an inner wall of a first opening of an upper end thereof to be screwed to the connector of an electronic device, and includes a shoulder 12 extending around a bottom end of an inner wall thereof, and includes a locking section 13 mounted on an outer wall thereof and formed in a hexagon shape to correspond to an allen wrench.

The internal tube 20 is fitted to the connecting sleeve 10 and formed in a hollowly elongated tube shape to insert a core segment of the cable, and includes an arresting ring 21 extending outward around an upper end thereof to abut against the shoulder 12 of the connecting sleeve 10 so as to prevent the connecting sleeve 10 from sliding out of the internal tube 20, and includes a circular groove 22 arranged around an outer wall thereof.

The inner fitting member 30 is a hollow housing, and includes an orifice formed on a bottom end of a fifth opening thereof, and includes a hole 31 disposed on a top surface thereof, the hole 31 includes a circular projection 311 formed around an inner surface thereof to correspond to the circular groove 22 of the internal tube 20 such that the inner fitting member 30 is fitted to the outer wall of the internal tube 20 by using the hole 31 and further enable to rotate the connecting sleeve 10. The inner fitting member 30 also includes at least one curved recess 32 formed on an upper end of an outer wall thereof, and the recess 32 becomes concaved upward to downward from the upper end of the inner fitting member 30 and the recess 32 bends toward one side of the inner fitting member 30 and extends downward, and the inner fitting member 30 further includes an insertion 35 extending from a bottom end thereof;

the inner fitting member 30 further includes an annular slot 33 formed on a lower section of an external surface thereof, and the annular slot 33 includes a washer 34 fitted thereon.

The outer fitting member 40 is a hollow housing and includes two ends, each having a second opening, to be fitted to the inner fitting member 30, and includes a protrusion 41 extending from an inner rim of the second opening of a top end thereof in response to the recess 32 of the inner fitting member 30 so that the protrusion 41 is fixed in the recess 32 to slide, and includes a first fixing section 42 disposed on a bottom end thereof, the first fixing section 42 is at least one retaining trench 421 and at least one concavely circular member 422.

The sheath member 50 is flexible and formed in a tube shape, and includes two ends, each having a third opening, includes a bore 51 mounted on an upper end thereof. The bore 51 includes a waterproof member 511 extending from an inner surface thereof and becoming tilted toward a central portion thereof slightly, includes an annular cutout 512 formed on an outer surface thereof. The sheath member 50 also includes a circular rib 52 fixed thereon to correspond to the concavely circular member 422 of the outer fitting member 40, and includes a raised loop 53, an outer diameter of which is in response to an inner surface of the outer fitting member 40. The raised loop 53 is formed in a tube shape and includes two ends, each having a fourth opening, includes a second fixing section 54 arranged on an outer surface thereof to correspond to the retaining trench 421 of the first fixing section 42 of the outer fitting member 40, includes a circularly projected slit 531 disposed on an inner surface thereof to correspond to the annular cutout 512 of the bore 51. In this embodiment, the sheath member 50 is an engaging block to correspond to the retaining trench, to be retained by the retaining trench securely.

The circular paw piece 60 is a circularly metal ratchet paw and includes a plurality of paws 61 arranged thereon to be fixed between the outer fitting member 40 and the raised loop 53, and the paw 61 is a resilient metal element and tilts forward lightly.

In assembly, the paws 61 of the circular paw piece 60 are expanded to be fitted to the insertion 35 of the inner fitting member 30 securely, and the protrusion 41 of the outer fitting member 40 is placed to a fifth opening above the recess 32 of the inner fitting member 30 to slide from the recess 32. Thereafter, the prepared cable is inserted from the third opening of a bottom end of the sheath member 50, and the core segment of the cable is pushed to insert through the internal tube 20, a jacket of the cable is fitted outside the internal tube 20. In the meantime, the inner fitting member 30 is rotated relative to the outer fitting member 40 so that the protrusion 41 slides to a bottom end of the recess 32, and the sheath member 50 is actuated by the outer fitting member 40 to slide downward, the paws 61 of the circular paw piece 60 disengages from the insertion 35 of the inner fitting member 30, hence the paws 61 engages with the jacket of the cable securely.

While we have shown and described various embodiments in accordance with the present invention, it is clear to those skilled in the art that further embodiments may be made without departing from the scope of the present invention.

What is claimed:

1. A connector for a cable comprising a connecting sleeve formed in an annular tube shape, and including threads formed around an inner wall of a first opening of an upper end thereof, and including a shoulder extending around a bottom end of an inner wall thereof;

an internal tube fitted to the connecting sleeve and formed in a hollowly elongated tube shape to insert a core segment of the cable, and including an arresting ring extending outward around an upper end thereof to abut against the shoulder of the connecting sleeve, and including a circular groove arranged around an outer wall thereof;

an inner fitting member being a hollow housing, and including an orifice formed on a bottom end of a fifth opening thereof, and including a hole disposed on a top surface thereof, the hole including a circular projection formed around an inner surface thereof to correspond to the circular groove of the internal tube such that the inner fitting member is fitted to the outer wall of the internal tube by using the hole and further enable to rotate the connecting sleeve, the inner fitting member also including at least one curved recess formed on an upper end of an outer wall thereof, and the recess becoming concaved upward to downward from the upper end of the inner fitting member, after bending toward one side of the inner fitting member and extending downward, and the inner fitting member further including an insertion extending from a bottom end thereof;

an outer fitting member being a hollow housing and including two ends, each having a second opening, to be fitted to the inner fitting member, and including a protrusion extending from an inner rim of the second opening of a top end thereof in response to the recess of the inner fitting member, and including a first fixing section disposed on a bottom end thereof;

a sheath member being flexible and formed in a tube shape, and including two ends, each with a third opening, including a bore mounted on an upper end thereof, and the bore including a waterproof member extending from an inner surface thereof and becoming tilted toward a central portion thereof slightly, including an annular cutout formed on an outer surface thereof, the sheath member also including a raised loop, an outer diameter of which is in response to an inner surface of the outer fitting member, the raised loop including a second fixing section arranged on an outer surface thereof to correspond to a retaining trench of the first fixing section of the outer fitting member, including a circularly projected slit disposed on an inner surface thereof to correspond to the annular cutout of the bore;

a circular paw piece being a circularly metal ratchet paw and including a plurality of paws arranged thereon to be fixed between the outer fitting member and the raised loop, and the paw being a resilient metal element and tilting forward lightly.

2. The connector for the cable as claimed in claim 1, wherein the first fixing section is at least one retaining trench and at least one concavely circular member, the second fixing section of the raised loop of the sheath member is an engaging block to correspond to the retaining trench, and the sheath member includes a circular rib fixed thereon to correspond to the concavely circular member of the outer fitting member.

3. The connector for the cable as claimed in claim 2, wherein the inner fitting member, the outer fitting member, and the sheath member are made of plastic material.

4. The connector for the cable as claimed in claim 3, wherein the connecting sleeve includes a locking section mounted on an outer wall thereof.

5. The connector for the cable as claimed in claim 4, wherein the inner fitting member includes an annular slot formed on a lower section of an external surface thereof, and the annular slot includes a washer fitted thereon.

* * * * *